US005944853A

United States Patent [19]

Molock et al.

[11] Patent Number: 5,944,853

[45] Date of Patent: Aug. 31, 1999

[54] METHOD FOR PREPARING HALOTRIAZINE DYE- AND VINYL SULFONE DYE-MONOMER COMPOUNDS

[75] Inventors: Frank F. Molock; James D. Ford, both of Orange Park; Gregory A. Hill, Ponte Vedra Beach; Joe M. Wood, Jacksonville, all of Fla.

[73] Assignee: Johnson & Johnson Vision Products, Inc., Jacksonville, Fla.

[21] Appl. No.: 08/969,332

[22] Filed: Nov. 13, 1997

Related U.S. Application Data

[63] Continuation-in-part of application No. 08/603,383, Feb. 20, 1996, abandoned, which is a continuation of application No. 08/185,747, Jan. 24, 1994, abandoned, which is a continuation-in-part of application No. 07/966,232, Oct. 26, 1992, abandoned.

[51] Int. Cl.[6] ..... D06P 1/382; D06P 1/384

[52] U.S. Cl. ..... 8/506; 8/543; 8/549; 8/566; 8/587; 8/DIG. 2

[58] Field of Search ..... 8/507, 509, 543, 8/558, DIG. 2, 647, 506, 566, 587, 549; 351/162, 160 H; 252/182.15, 182.17, 182.18, 182.28

[56] References Cited

U.S. PATENT DOCUMENTS

| | | | |
|---|---|---|---|
| 4,093,361 | 6/1978 | Erickson et al. | 351/160 |
| 4,157,892 | 6/1979 | Tanaka et al. | 8/14 |
| 4,252,421 | 2/1981 | Foley, Jr. | 351/162 |
| 4,468,229 | 8/1984 | Su | 8/507 |
| 4,553,975 | 11/1985 | Su | 8/507 |
| 4,554,091 | 11/1985 | Jones et al. | 252/187.25 |
| 4,559,059 | 12/1985 | Su | 8/507 |
| 4,639,105 | 1/1987 | Neefe | 264/1.1 |
| 4,640,805 | 2/1987 | Neefe | 264/1.1 |
| 4,668,240 | 5/1987 | Loshaek | 8/507 |
| 4,680,336 | 7/1987 | Larsen et al. | 524/548 |
| 4,795,794 | 1/1989 | Winnick et al. | 526/259 |
| 4,857,072 | 8/1989 | Narducy et al. | 8/507 |
| 4,891,046 | 1/1990 | Wittmann et al. | 8/507 |
| 4,929,250 | 5/1990 | Hung et al. | 8/507 |
| 4,954,132 | 9/1990 | Hung et al. | 8/507 |
| 4,963,159 | 10/1990 | Narducy et al. | 8/507 |
| 4,963,160 | 10/1990 | Hung et al. | 8/507 |
| 5,021,068 | 6/1991 | Hung et al. | 8/507 |
| 5,098,445 | 3/1992 | Hung et al. | 8/507 |
| 5,151,106 | 9/1992 | Bhaumik et al. | 8/507 |
| 5,292,350 | 3/1994 | Molock et al. | 8/507 |

FOREIGN PATENT DOCUMENTS

| | | |
|---|---|---|
| A-0 072 353 | 2/1983 | European Pat. Off. . |
| A-0-396 376 | 11/1990 | European Pat. Off. . |
| A-0 595 575 | 5/1994 | European Pat. Off. . |
| 62-265357 | 5/1986 | Japan . |
| 4-293010 | 10/1992 | Japan . |
| A-1 400 892 | 7/1975 | United Kingdom . |
| A-92 11407 | 7/1992 | WIPO . |

OTHER PUBLICATIONS

"Analytical Evaluation of the Purity of Commercial Preparations of Cibacron Blue F3GA and Related Dyes" D. Hanggi and P. Carr; Anal. Biochem. vol. 149, pp. 91–104(Feb. 1985).

English language translation of Seiko–Epson K.K., JP 4–293,010, pp. 1–16, Oct. 1992.

*Primary Examiner*—Caroline D. Liott

*Attorney, Agent, or Firm*—Anne B. Kiernan

[57] ABSTRACT

A highly purified monomer-dye unit is disclosed. A method for producing a highly purified monomer-dye unit is also disclosed. A hydrophilic monomer is reacted with a halotriazine or vinyl sulfone dye in the presence of a base under conditions that yield highly pure monomer-dye units.

24 Claims, No Drawings

METHOD FOR PREPARING HALOTRIAZINE DYE- AND VINYL SULFONE DYE-MONOMER COMPOUNDS

This application is a continuation-in-part of U.S. Ser. No. 08/603,383, filed Feb. 20, 1996, now abandoned, which is a continuation of U.S. Ser. No. 08/185,747, filed Jan. 24, 1994, now abandoned, which is a continuation-in-part of U.S. Ser. No. 07/966,232, filed Oct. 26, 1992, now abandoned, the entire contents of all three applications are incorporated by reference herein.

BACKGROUND OF THE INVENTION

This invention relates to a method for imparting color to a contact lens. More specifically, it relates to an improved method for preparing a highly pure compound of a hydrophilic monomer and a dye.

The conventional method for imparting an evenly dispersed tint in a soft contact lens is described, for example, in U.S. Pat. No. 4,468,229. Generally, the lens is first soaked in an aqueous solution of the dye, and then the dye is bonded to the lens in a separate solution. The lens is typically composed of a hydrophilic polymer derived from the polymerization of hydrophilic monomers. The bonding of the dye to the lens is carried out by contacting the soaked lens with an aqueous base prior to the final hydration step, which is intended to provide the soft, hydrogel lens with the desired amount of water at an acceptable pH.

The dyes which are used in the conventional method are typically derived from a halotriazine such as a dihalotriazine or monohalotriazine, especially water-soluble dichlorotriazines. Dichlorotriazine or monohalotriazine dyes that carry sulfonate functionalities, for example, are soluble in water, so it is necessary that bonding occur with the hydrophilic polymer from which the lens is composed before the final hydration step. Otherwise, the dye could migrate within the lens to create an uneven dispersion, or leach out from the lens into the eye of the wearer.

The dye which imparts the tint to a soft lens made using the conventional method not only is dispersed in the lens, but also does not migrate within the lens or leach out of the lens after the bond has formed. The tinted lens is stable in an aqueous medium, and after repeated high temperature cycling, conditions which are present during routine wear and cleaning. The conventional method requires that the lens be soaked in a solution containing the dye which is at a specific concentration, and at a specific conductivity, so that the dye diffuses into the polymer. The conductivity is important since one may control the swelling of a lens by selecting various salt concentrations. It is also important that the dye concentration and time the lens stays in the dye soak be precisely controlled since the diffusion kinetics determine the intensity of the tinted contact lens. The conventional method employs a high concentration of dye in the dye wash so that the continuous tinting can be managed. Unfortunately, this method is cumbersome and requires multiple steps, especially at commercial scale production, because it is necessary to soak the lens in a solution of the dye at a specific concentration and time to create a dispersion of the dye in the lens. Therefore, because of this difficulty, alternative methods have been sought.

U.S. Pat. No. 4,559,059 mentions that it might be possible to react a monomer such as 2-hydroxyethyl methacrylate with a reactive dye prior to polymerization, and subsequently to polymerize the monomer dye units during polymerization of the monomers from which the lens is derived.

However, this patent does not describe the method nor reaction conditions necessary to prepare the polymerizable monomer-dye units.

U.S. Pat. No. 4,157,892 discloses adding a functionality to the polymer from which the lens is derived which is reactive with the dye. The functionalized polymer is prepared by reacting a "coupler monomer" with a conventional hydrophilic monomer. This coupler monomer has a high probability of changing the physical properties of the polymer. The lens prepared from the functionalized polymer is immersed in a solution of a diazonium dye, where the dye then bonds to the polymer. Although adequate bonding occurs, this method still requires immersion of the finished lens in a solution of the dye.

Another method for imparting color to a soft lens is disclosed in U.S. Pat. No. 4,640,805. This patent describes preparing a tinted lens using a conventional spin casting technique. A suspension of dye pigment in liquid monomer is applied to the mold surface prior to polymerization of bulk monomer in the spin cast mold. Although this method provides a simple way for imparting color to the surface of the lens, it does require that the mold be stamped or printed with specific geometries and spacing.

Attempts have been made to incorporate the dye in the lens by polymerizing the hydrophilic monomer from which the lens is derived in the presence of the dye. For example, U.S. Pat. No. 4,252,421 discloses polymerizing a hydrophilic monomer in the presence of a water-insoluble phthalocyanine dye. The dye is supposed to become entrapped in the finished, hydrated lens because of its incompatibility with water. Unfortunately, the dye will leach out of a lens derived from polymerizing the most commonly used hydrophilic monomer, hydroxyethyl methacrylate (HEMA), when the lens is fully hydrated to greater than about 40 weight percent water. This is even more of a problem with higher water content materials.

The '421 patent also discloses functionalizing the dye with a polymerizable vinyl group, and then subsequently bonding the functionalized dye during polymerization of the monomers from which the lens is derived. Although this eliminates the need for a post-bonding step, the water content of the lens is adversely affected unless hydrophilic —$SO_3H$ or —$SO_3Na$ groups are added to the phthalocyanine dye nucleus (as discussed at column 8 of the patent). This simply adds another burdensome step in the manufacturing process to make a contact lens suitable for extended wear applications.

In a similar manner, European Patent Application 0 396 376 discloses the use of a non-charged anthraquinone dye which is functionalized with a polymerizable group to facilitate bonding of the functionalized dye during polymerization of the hydrophilic monomer. Unfortunately, the non-charged dye leads to lower water solubility, if any at all, which in turn restricts the concentration of the dye which can be present in the lens. More importantly, however, the functionalized anthraquinone dye is by necessity a difunctional dye in this case. This difunctionality creates in effect a dye which is a crosslinker. As a result, the water content of the lens is further lowered, and lenses made with this difunctional dye are unacceptably brittle when the concentration of the dye in the lens is increased.

Finally, another attempt to impart color to a contact lens is disclosed in U.S. Pat. No. 4,639,105. This patent discloses spin casting a mixture of liquid monomer, soluble dye and pigment particles to prepare a lens with variations in color achieved by migration of the pigment particles during spin casting. Although this patent indicates that the dyes do not migrate, no reference is made of what specific dyes are used, and it is believed that such dyes will indeed migrate or leach during wear unless the dye used is functionalized with polymerizable groups as described above. Furthermore, such a lens is unsuitable for those applications where a uniform dispersion of dye or colorant is necessary or desired.

U.S. Pat. No. 4,795,794 discloses monomer-dye intermediates by reacting substituted anthraquinones with methacryloyl chloride to produce colored methacrylate compounds (monomer-dye intermediates) which were further polymerized with styrene and other methacrylates to produce polymers used as colored toner particles for copier applications. '794 separates the monomer-dye intermediates by methyl alcohol quench, vacuum concentration, methyl alcohol wash and filtration followed by recrystallization from either methyl cellosolve or methyl alcohol. The recrystallization step is extremely tedious and hazardous.

A drawback with typical reactions for coupling a dye to a hydrophilic monomer unit stems from the impurity of the commercially available dyes used to dye contact lenses. These impurities range from high concentrations of inorganic salts to surfactants used as antidusting agents or to speed dissolution of the dyes. The above components are added, because the major application of these dyes is for the tinting of cellulosic textile materials. These additives make the reactive dye more functional in the textile processes. Synthetic impurities include dye precursors and reaction by-products. The usual result of reacting these dyes with a hydrophilic polymer is a very low percentage of dye attached to the polymer relative to the amount of dye used, and then the unreacted materials and impurities must be washed out of the lens. The washing step is an additional processing step to complicating the production of colored contact lenses. Thus, it is an object of the present invention to provide a highly purified monomer-dye unit. It is also an object of the invention to provide a simple method for making a highly purified monomer-dye unit, which can be used to color contact lenses.

In view of the deficiencies of the prior art, an economical method is needed to prepare a tinted contact lens without requiring the step of immersing the finished lens in a solution of the dye.

SUMMARY OF THE INVENTION

This invention provides an improved, and simplified method for preparing highly pure polymerizable monomer-dye compounds, preferably monofunctional monomer-dye compounds, also referred to as monofunctional dyes, that may be polymerized with other monomers, preferably for the production of colored, soft hydrogel contact lenses.

The improvement comprises reacting the dye with the hydrophilic monomer under conditions effective to prepare a polymerizable monomer-dye compound of high purity. The high purity monomer-dye compounds can then be combined with additional hydrophilic monomers preferably in a homogeneous solution and the monomers are polymerized together to form colored, soft hydrogel contact lens polymers. The improved method of this invention eliminates the need to immerse the lens in an aqueous solution of the dye after polymerization of the hydrophilic monomer from which the finished lens is derived. Additionally, it is unnecessary to bond dye to the lens after the lens is formed. This is so because the polymerizable monomer-dye compounds are polymerized with the hydrophilic monomers from which the soft hydrogel contact lens is made and therefore is an integral part of the polymer backbone of the lens. Further, because the monomer-dye compound is highly pure there is no need to wash residual dye or impurities out of or off the lens after polymerization of the monomer-dye compounds and hydrophilic monomers to form the lens.

The intensity of the tint in the lens can be controlled accurately and simply by varying the concentration of the polymerizable monomer-dye compound in the reaction solution with the hydrophilic monomer used to form the contact lens. There is no guessing about the amount and diffusion rates which complicate the prior art methods. Furthermore, the physical and optical properties of the tinted lens are essentially equivalent to the physical and optical properties of a corresponding lens without the incorporation of the dye. For example, handling characteristics, wearer comfort, and lens clarity are not sacrificed when the dye is incorporated into the lens using the improved method of this invention. Additionally, the fact that the monomer-dye compound does not act as a crosslinking agent, because of its predominant monofunctionality, allows for the incorporation of increased amounts of the dye in the lens without sacrificing the water content and handling characteristics, e.g. flexibility, of the lens.

DETAILED DESCRIPTION OF THE INVENTION

This invention provides the method of making a monomer-dye compound according to the following steps:

a) forming a basic aqueous solution comprising hydrophilic monomer, water-soluble halotriazine dye, base and water; and b) reacting said water-soluble dye with said hydrophilic monomer to form a water insoluble precipitate, said precipitate being a monomer-dye compound.

To form the monomer-dye compounds of this invention all or substantially all of the reactants are water soluble. The reaction between the hydrophilic monomer and the dye forms a water insoluble monomer-dye compound. As the reaction product is produced, it precipitates from aqueous solution in a highly pure form, because the reagents are all water soluble, that is, the unreacted hydrophilic monomer, unreacted dye, and base all stay in aqueous solution when the highly pure reaction product monomer-dye compound is separated from the solution by a simple separation method. Examples of simple separation methods include filtering, and centrifuging with or without washing with water, salt-water solutions, or mild aqueous solutions. The precipitate when separated from the solution by filtering, for example by using filter paper having 1 micon size pores, with or without an aqueous wash, will provide a monomer-dye compound having a purity determined by high pressure liquid chromatography (HPLC) of 50% or higher, more preferably 85% or higher. It is not necessary to recrystalize the participate or wash with organic solutions to obtain a highly pure monomer-dye compound. After filtering the monomer-dye compound can be used as is in the reaction mixture to form a contact lens. However, it is preferred that the monomer-dye compound be dried prior to use inorder to increase the accuracy of the weight measurements of the monomer-dye compound.

The preferred class of halotriazine dyes for reaction with the hydrophilic monomer, for example, 2-hydroxyethyl methacrylate are dihalotriazine dyes, especially dichlorotriazine dyes with at least one sulfonate functionality to render the dye water-soluble. The halotriazine dyes are anionic dyes. Such dichlorotriazine dyes are described, for example, in U.S. Pat. Nos. 4,559,059 and 4,891,046, each of which is incorporated by reference herein. The most preferred dichlorotriazine dye is Color Index Reactive Blue 4 which has the chemical name 2-anthracenesulfonic acid, 1-amino-4-(3-((4,6-dichloro-s-triazin-2-yl)amino)-4-sulfoanilino)-9,10-dihydro-9,10-dioxo. Monochlorotriazine dyes with at least one sulfonate functionality such as Reactive Blue #2 can also be reacted with 2-hydroxyethyl methacrylate to form the monomer-dye compounds. The water soluble dyes which can be utilized in addition to Color Index Reactive Blue 4 include the dye which is sold under the trademarks Procion Blue MRS or Fiber Reactive Brilliant Blue MRS. This dye has the chemical name 2-anthracenesulfonic acid, 1-amino-4-(3-((4,6-dichloro-s-triazin-2-yl)amino)-4-sulfoanilino)-9,10-dihydro-9,10-dioxo, disodium salt, or the chemical name 2-anthracenesulfonic acid, 1-amino-4-(3-((4,6-dichloro-1,3,5-triazin-2-yl) amino)-4-sulfophenyl)amino)-9,10-dihydro-9,10-dioxo, disodium salt.

In addition, a water soluble vinyl sulfone dye, such as Color Index Reactive Black #5 (Remazol Black B, CAS 17095-24-8) may be used to react with a hydrophilic monomer, for example, 2-hydroxyethyl methacrylate, to produce a highly pure polymerizable monomer-dye compound that may be polymerized with another monomer such as 2-hydroxyethyl methacrylate, thereby producing a colored, soft hydrogel contact lens.

The conditions for reacting the water soluble halotriazine dye or the vinyl sulfone dye with the hydrophilic monomer in order to prepare a predominantly monofunctional dye will depend on the specific monomer chosen and the type of halotriazine dye or the vinyl sulfone dye used. These conditions can readily be determined empirically. For example, the addition of salt, for example a 2 to 5% sodium chloride solution, to the reaction mixture may help form the precipitate for some monomer-dye compounds, depending on the purity of the dye.

It is preferred that the monomer-dye compound is highly monofunctional. The polymerizable dye is highly monofunctional if as a result of the reaction not less than 50 percent of the polymerizable monomer-dye compounds formed have only one site of reactive functionality derived from the reaction of the dye with the hydrophilic monomer. If more than 50 percent of the polymerizable monomer-dye compounds are difunctional, then the dye will act as a crosslinker which may adversely affect the physical properties of the finished lens. Preferably, not less than 80 percent of the polymerizable monomer-dye compounds are monofunctional. Ideally, at least 95 percent of the polymerizable dye is monofunctional.

The reaction of the dye with the monomer occurs in the presence of a base which is capable of solubilizing the monomer and the dye. Preferably, the molar amount of the base is equal to or greater than the molar amount of the dye. Although the molar ratio of base to dye can be about 2:1 or 3:1, it is preferred that the molar ratio of base to dye is 1:1. The molar ratio of the dye to the monomer is preferably between 0.8:1 to 2.0:1, more preferably between 1:1 to 1.5:1, and most preferably about 1.25:1. The reaction between the monomer and the dye can be driven faster to completion if an equimolar or molar excess of the dye relative to the monomer, or an excess of the monomer relative to the dye is added to the reaction mixture depending upon the dye and monomer in the reaction mixtutre. The Reaction mixture to form the monomer-dye compound preferably comprises 10–65 weight %, more preferably 25–40 weight % hydrophilic monomer based on the weight of the reagents in the reaction mixture. The most preferable composition of the reaction mixture used to make the monomer-dye compound comprises an about equal molar ratio of base, monomer and dye.

The reaction temperature is preferably raised above room temperature, e.g. 35–70° C., for about 16 to 32 hours. When the reaction is complete, as determined by high pressure liquid chromatography (HPLC) or by any method known to a person of ordinary skill in the art, the mixture is preferably neutralized to a pH of between 5–8, preferably by the addition of an acid. Any excess reactants, solvent and by-products can be separated from the reactive dye compounds using conventional methods, such as decanting, centrifuging or filtering. The separation of the monomer-dye compound from the reaction solution is simplified by the fact that the monomer-dye compound is insoluble in the basic solution and precipitates out of the solution. The precipitate can be washed using water, salt and water or aqueous solutions. After simple separation and the optional washing, the method of this invention of attaching a dye as a pendant group on a hydrophilic monomer to form a hydrophilic monomer-dye compound and separating the precipitated monomer-dye compound from the reactants yields monomer-dye compounds having a chromatographic purity of at least 85%, more preferably of at least 95% and even more preferably as high as 100%. The chromatographic purity can be determined by using high pressure liquid chromatography (HPLC), for example, by using a reverse phase ODS C-18 column having a 5 micron particle size, or by using any of the HPLC method described in Hanggi et al, *Analytical Biochemistry,* Vol. 149, pp. 91–104 (1985), which is incorporated herein by reference. A monomer-dye compound with a chromatographic purity of at least about 85% is useful in preparing tinted contact lenses.

The purpose of the base is to neutralize acid which is formed during the reaction between the monomer and the dye. Examples of suitable bases are alkali or alkaline earth metal carbonate, phosphate, or hydroxides, for example, potassium hydroxide, sodium hydroxide, potassium carbonate, and sodium carbonate.

As used herein, a soft hydrogel contact lens refers to a gel-like lens derived from polymerizing a monomeric composition containing a hydrophilic monomer. A hydrophilic monomer refers to any monomer which, when polymerized, yields a hydrophilic polymer capable of forming a hydrogel when contacted with water. Examples of hydrophilic monomers include, but are not limited to, hydroxy esters of acrylic or methacrylic acid, N,N dimethylacryamide (DMA), N-vinyl pyrrolidone (NVP), and styrene sulfonic acid, and other hydrophilic monomers known in the art. The subsequently formed polymeric lens is swollen with a significant amount of water to form the hydrogel lens, typically greater than 30 percent and preferably at least 65 percent water.

The preferred hydrophilic monomer used to form the monomer-dye compound is an hydroxy ester of acrylic or methacrylic acid. Examples of hydroxy esters of acrylic and methacrylic acid include, but are not limited to, hydroxyethyl methacrylate (HEMA), hydroxyethylacrylate (HEA), glycerylmethacrylate, hydroxypropylmethacrylate, hydroxypropylacrylate, and hydroxytrimethyleneacrylate. The most preferred hydroxy ester of acrylic or methacrylic acid is HEMA, which is the monomer most commonly used in the preparation of soft hydrogel contact lenses.

The monomer-dye compounds formed by the process of this invention are used to form contact lenses, by reacting them with additional hydrophilic monomer, which may be the same or different as the hydrophilic monomer used to form the monomer-dye compound. Preferably the monomer-dye compounds and hydrophilic monomer are copolymerized with comonomers in a monomer reaction mixture to impart specific improvements in chemical and physical properties, depending on the particular application desired. For example, the equilibrium water content of the lens can be increased if methacrylic acid (MAA) is used as a comonomer. Additionally, polyfunctional crosslinking monomers, such as ethylene glycol dimethacrylate (EGDMA) and trimethylolpropane trimethacrylate (TMPTMA) can be used as comonomers in relatively small amounts in the reaction mixture to improve the dimensional stability and other physical properties of the lens. Similarly, other components may be added for specific applications, for example, to impart UV absorbing properties to the lens.

To form a contact lens comprising monomer-dye compounds and hydrophilic monomer, the monomer reaction mixture preferably includes an initiator, usually from about 0.05 to 1 percent of a free radical initiator which is thermally activated. Typical examples of such initiators include lauroyl peroxide, benzoyl peroxide, isopropyl percarbonate, azobisisobutylnitrile, and known redox systems such as the ammonium persulfate-sodium metabisulfite combination and the like. Irradiation by ultraviolet light, electron beam or a radioactive source may also be employed to initiate the polymerization reaction, optionally with the addition of a polymerization initiator, e.g. benzoin and its ethers.

The polymerization of the monomer reaction mixture to form the lens is carried out after the mixture is contacted with the required amount of the polymerizable monomer-dye compound, and a homogeneous solution of the dye in the mixture is formed. The amount of time required to form the homogeneous solution can be readily determined empirically.

The desired degree of contact lens tinting is established empirically by mixing various amounts of the monomer-dye compounds with hydrophilic monomers before polymerization. The proper ratio will depend on the desired color, the thickness of the periphery of the lens, and the ratio of monomeric reactants.

Preferably, the improved method of this invention is used to impart a visibility or handling tint to the lens. This is an amount which enables a wearer to visibly notice the lens during handling if the contact lens is temporarily misplaced, but the amount should not be such that the colored periphery of the lens is easily distinguishable from the cornea of the wearer during use. The amount of monomer-dye compounds added to the homogeneous solution of monomers which upon polymerization form the contact lens polymer to achieve a desired visibility tint will depend on the purity of the monomer-dye compound added to the solution, and therefore, it should be determined empirically. Generally, the weight of monomer-dye compound added to the homogeneous solution used to form the contact lens polymer should range from about 0.01 to about 0.35 weight percent based on the weight of the hydrophilic monomer used to form the contact lens, preferably from about 0.01 to about 0.20 weight percent based on the weight of the hydrophilic monomer. The most preferred range is from about 0.05 to about 0.15 weight percent.

Alternatively, the improved method of this invention offers the flexibility to impart an enhancement tint to the lens. An enhancement tint simply enhances the wearer's original eye color so that, for example, blue eyes will appear more "blue" with the enhancement tint on the lens. The amount of polymerizable dye added to the homogeneous solution for an enhancement tint desirably ranges from about 0.35 to about 0.75 percent based on the weight of the hydrophilic monomer, preferably from about 0.35 to about 0.50 percent. The polymerization can be carried out in the presence or absence of an inert diluent. If the polymerization is carried out in the absence of a diluent the resulting polymeric composition can be formed, as for example by lathe cutting, into the desired lens shape, and then swollen with the requisite amount of water following this operation. Alternatively, and more preferably, the polymerization is carried out in the presence of a suitable inert diluent. The preferred inert diluent is a water-displaceable boric acid ester. Additional diluents include those disclosed in U.S. Pat. Nos. 4,495,312, 5,304,584, and 5,594,043, incorporated herein by reference. The characteristics of desired boric acid esters as well as the preferred concentration of ester in the polymerization reaction mixture is described in detail in U.S. Pat. No. 4,680,336, which is incorporated by reference herein. The preferred methods for forming the desired lens when a diluent is used include centrifugal casting and cast molding, for example, using molds described in U.S. Pat. No. 4,565,348, incorporated herein by reference, as well as combinations of these methods with the other methods described generally herein.

When the polymerization reaction between hydrophilic monomer and monomer-dye compounds is complete, the lens can be hydrated to its equilibrium water content. Preferably, the water content of the lens will range from about 35 to about 80 weight percent, more preferably from about 55 to about 65 weight percent. This range is considered ideal for extended wear applications where patient comfort and handling characteristics are critical properties.

The following Examples are intended to illustrate the claimed invention and are not in any way designed to limit its scope. Numerous additional embodiments within the scope and spirit of the claimed invention will become apparent to those skilled in the art.

The components used in the preparation of the contact lenses of the Examples are abbreviated as follows: 2-hydroxyethyl methacrylate (HEMA), methacrylic acid (MAA), ethyleneglycol dimethacrylate (EGDMA), boric acid ester of glycerin (0.16 moles boron per mole of glycerin) (GBAE), an ethoxylated methylglucosidedilaurate (MLE-80), Reactive Blue #4 [2-anthracenesulfonic acid, 1-amino-4-(3-((4,6-dichloro-s-triazin-2-yl)amino)-4-sulfoanilino)-9,10-dihydro-9,10-dioxo] (RB4) which is a dichlorotriazine dye, and α-hydroxy-α, α-dimethylacetophenone (Darocur 1173) which is a UV reactive initiator. The 2-hydroxyethyl methacrylate used in all of the examples is highly purified 2-hydroxyethyl methacrylate with less than 0.1 wt. % impurities.

The test methods for determining the physical and optical properties set forth in Table 1 of the Example are as follows:

Oxygen Permeability

The oxygen permeability through the lens is expressed as the Dk value multiplied by $10^{-11}$ in units of cm•ml 02/sec•ml•mm Hg. It is measured using a polarographic oxygen sensor consisting of a 4 mm diameter gold cathode and silver-silver chloride ring anode.

Tensile Properties (Modulus, Elongation and Strength)

The lens to be tested is cut to the desired specimen size and shape and the cross-sectional area measured. The specimen is then attached into the upper grip of a constant rate-of-crosshead-movement type of testing machine equipped with a load cell. The crosshead is lowered to the initial gauge length and the specimen attached to the fixed grip. The specimen is then elongated at a constant rate of strain and the resulting stress-strain curve is recorded. The elongation is expressed in percent and the tensile modulus and strength are expressed in psi (pounds per square inch).

UV Transmission

This method is applicable to the determination of light transmission through the lens. A beam of light ((200–800 nm)) is passed through a quartz cell containing the lens in solution. The intensity of light exiting the cell is measured and ratioed against the incident (reference) beam. The values are expressed in % transmission.

Tint Stability

The lens is sterilized in an autoclave for 30 minutes, and qualitatively compared to a non-autoclaved lens for loss of tint intensity. This procedure is repeated 5 times and a lens which does not lose tint intensity passes the test.

Chromatographic purity of monomer-dye compounds

The chromatographic purity of the monomer-dye compounds were measured in a similar fashion to the HPLC method described in Hanggi et al, *Analytical Biochemistry,* Vol. 149, 91–104 (1985).

EXAMPLE 1

Reactive Dye RB4 Bound to HEMA: Synthesis 1

To a 500 ml round bottom flask is placed 350 ml of a 5% solution of $K_2CO_3$. To this is added 0.10 (13.0 g) mole of HEMA, and the mixture is stirred for 10 minutes. To the above solution is added 0.08 (51.0 g) mole of RB4. After the dye is fully dispersed, the temperature is raised between 40–50° C. The reaction is followed using the chromatographic HPLC method described in Hanggi et al, Analytical Biochemistry 149, 91–104 (1985), for monitoring the reaction of chlorotriazine dyes with monofunctional alcohols. Using this method, the formation of the monosubstituted monochlorotriazine-HEMA polymerizable dye is seen at approximately 42 minutes.

When sufficient conversion is achieved after 40–50 hours, the reaction mixture can be filtered and the filter cake collected and dried. This filter cake can be used "as is" to tint contact lenses. The filtrate can be vacuum stripped using a rotary evaporator to remove the water from the reaction product. The remaining blue powder, which is the monomer-dye compound can be used to tint lenses.

EXAMPLE 2

Reactive Dye RB4 Bound to HEMA: Synthesis 2

The reaction described can be carried out in the following manner to afford approximately 85% pure as determined by HPLC monofunctional monochlorotriazine-HEMA polymerizable dye. Into a two liter three neck jacketed flask (the chiller temperature should have been set to 22° C. before addition of reagents) equipped with mechanical agitation is placed 497.2 g (27.62 moles) of water and 9.95 g (0.0721 moles) of $K_2CO_3$ (ACS grade, Aldrich # 20,961–9). This solution is allowed to equilibrate to 22° C. before adding additional reagents. The reaction temperature should be monitored while reagents are being added. The pH of the above solution is maintained at 10–12. To this solution are added 497.2 g (3.82 moles) of highly purified HEMA which contains 0.1263% EGDMA and 0.0275% MAA as impurities (Rhom Tech Mhoromer BM-920 used); this mixture should be allowed to equilibrate to 22° C. A total of 76.5 g (0.120 mole) RB#4 is added and the solution allowed to mix for thirty minutes or until all clumps have dissipated. The temperature of the reaction is raised to 40° C. and the disappearance of the RB#4 peak is monitored by HPLC. When the RB#4 peak is less than 3% (approximately 170 hours) of the total chromophobic peak area the reaction mixture is neutralized with a dilute solution of HCl (40:1) until the pH is approximately 6.5 to 7.0. Stir for 30 minutes and filter. The filter cake is transferred from the Buchner funnel to a vacuum desiccator and allowed to dry. Mortar and pestle filters can optionally be washed with diethyl ether, ethyl alcohol, acetone, or methyl alcohol to remove any organic impurities e.g. EGDMA, MAA or Ethylene Glycol.

EXAMPLE 3

Reactive Dye RB4 Bound to HEMA: Synthesis 3

To a one liter flask were added 76.5 g Reactive Blue #4 and 450 g deionized water. The contents were mixed 30 minutes at room temperature. To the flask was added 497.5 g of hydroxyethyl methacrylate (HEMA). The contents were mixed 20 minutes. A solution of 12.7 g of potassium carbonate in deionized water was then added. The contents were heated to 40° C. for 96 hours. The mixture was neutralized with 2.5N sulfuric acid to a pH of 6.5. The contents of the flask were cooled to 5° C. for 24 hours. The product was recovered by vacuum filtration. The moist solid was suspended in 100 g of a solution of 50 g deionized water and reagent (ethyl) alcohol. The product was recovered by vacuum filtration. The product of this washing was suspended in 100 g of reagent (ethyl) alcohol and collected by vacuum filtration. This product was dried at room temperature at a vacuum of <1 mm Hg.

The product of this synthesis, the monomer-dye compound, yielded 19.9 g of a blue powder which gave a single peak when analyzed by HPLC, indicating a chromatographic purity of 100%.

EXAMPLE 4

Reactive Dye RB4 Bound to HEMA: Synthesis 4

To a one liter flask were added 75 g Reactive Blue #4 and 572.5 g deionized water. The contents were mixed 30 minutes at room temperature. To the flask were added 187.5 g of hydroxyethyl methacrylate (HEMA). The contents were mixed 20 minutes. To the solution were added 11 g of a 50% solution of sodium hydroxide. The contents were stirred at room temperature for one hour. The mixture was neutralized with 2.5N sulfuric acid to a pH of 6.5 The contents of the flask were cooled to 5° C. for 24 hours. The product was recovered by vacuum filtration. The moist solid was suspended in 100 g of a solution of 50 g deionized water and reagent (ethyl) alcohol. The product was recovered by vacuum filtration. The product of this washing was suspended in 100 g of reagent (ethyl) alcohol and collected by vacuum filtration. This product was dried at room temperature at a vacuum of 1 mm Hg.

The product of this synthesis yielded 17.2 g of a blue powder which gave a single peak when analyzed by HPLC, indicating a chromatographic purity of 100%.

EXAMPLE 5

Reactive Dye RB5 Bound to HEMA: Synthesis 5

To a 100 ml flask was added 9.0 g Reactive Black #5 (Remazol Black B, CAS 17095-24-8) and 57.2 g deionized water, the contents were mixed for 30 minutes at room temperature. To the flask was added 18.7 g of 2-hydroxyethyl methacrylate. The contents were mixed for 20 minutes. To the solution was added 1.04 g of a 50% solution of sodium hydroxide. The contents were stirred at room temperature for 1 hour and 20 minutes. The mixture was neutralized with 2.5N sulfuric acid to a pH of 6.0. The contents of the flask were cooled to 5° C. for 24 hours. The product was recovered by vacuum filtration. This product was dried at room temperature at a vacuum of less than 1 mm Hg. The product of this synthesis yielded 0.52 g of a blue powder which gave a single peak when analyzed by HPLC.

Preparation of Tinted Contact Lens with High Water Content

The following components are mixed to form a homogeneous blend: 58.08 parts HEMA, 0.71 parts EGDMA, 0.96 parts MAA, 0.14 parts Darocur 1173, 0.07 parts of the polymerizable dye synthesized in Example 3, and 40 parts GBAE. The above blend is polymerized by exposure to UV light while being contained in a contact lens mold. The mold is opened after the polymerization is complete, the molded lens is submerged in either an aqueous solution of 0.50 percent MLE-80 or a 0.90% NaCl solution to which 0.50 percent MLE-80 has been added. The molds are put into the above solutions at a solution temperature between 60–70° C. The physical and optical properties of this tinted lens are shown in Table 1 as Example 1.

For comparison purposes, the physical and optical properties of an untinted lens, and a lens tinted using the conventional method, are shown in Table 1 as Control Examples A and B respectively. The untinted lens is prepared substantially identically to the method described above except no dye is used. The lens tinted using the conventional method is prepared by first soaking the untinted lens in a solution of RB4 containing 0.50 percent MLE-80, and then bonding the RB4 to the soaked lens by contact with aqueous base prior to final hydration.

TABLE I

Physical and Optical Properties of Tinted Contact Lenses

| Properties | Example 1 | Control Example A | Control Example B |
|---|---|---|---|
| | Physical Properties | | |
| Water Content % | 60 | 60 | 60 |
| Oxygen Permeability | 28 | 26 | 28 |
| Tensile Modulus, psi | 36 | 36 | 34 |
| Elongation, % | 120 | 118 | 128 |
| Tensile Strength, psi | 32 | 35 | 34 |
| | Optical Properties | | |
| UV Transmission Minimum % | 85 | 85 | 85 |
| Tint Stability | yes | — | yes |

The results shown in Table 1 illustrate that the physical and optical properties of the tinted contact lens made according to the improved method of the invention are substantially the same as those properties for the corresponding untinted contact lens and the contact lens tinted by the conventional process.

We claim:

1. A method of preparing a monomer-dye compound, comprising the steps of:

forming an aqueous solution comprising water and water-soluble reagents, said reagents comprising water-soluble hydrophilic monomer, water-soluble base, and water-soluble halotriazine dye;

reacting said water-soluble dye with said water-soluble hydrophilic monomer to form a monomer-dye compound, wherein said monomer-dye compound is insoluble in said aqueous solution; and separating said monomer-dye compound from said solution comprising said water-soluble reagents.

2. The method of claim 1, wherein said separating step is accomplished by filtering.

3. The method of claim 2, further comprising during said filtering step, rinsing said monomer-dye compound with water.

4. The method of claim 3, further comprising during said filtering step, rinsing said monomer-dye compound with salt and water.

5. The method of claim 1, further comprising prior to said separating step the step of:

adding salt to said aqueous solution.

6. The method of claim 1, wherein said water-soluble hydrophilic monomer is a hydroxy ester of acrylic or methacrylic acid.

7. The method of claim 1, wherein said hydrophilic monomer is 2-hydroxyethyl methacrylate.

8. The method of claim 1, wherein the amount of said hydrophilic monomer in said aqueous solution is about 10–65% by weight of the total weight of said reagents.

9. The method of claim 1, wherein equimolar amounts of said base and said dye are present in said solution during said forming step.

10. The method of claim 1, wherein the halotriazine dye is a dihalotriazine dye.

11. The method of claim 1, wherein said dye is a dichlorotriazine dye with at least one sulfonate functionality.

12. The method of claim 1, wherein filtering said dye-monomer compound from said aqueous solution and drying said monomer-dye compound will provide a monomer-dye compound having at least 50% purity as measure by High Pressure Liquid Chromatography.

13. A method of preparing a monomer-dye compound, comprising the steps of:

forming an aqueous solution comprising water and water-soluble reagents, said reagents comprising water-soluble base, water-soluble hydrophilic monomer, and water-soluble vinyl-sulfone dye;

reacting said water-soluble dye with said water-soluble hydrophilic monomer to form a monomer-dye compound, wherein said monomer-dye compound is insoluble in said aqueous solution; and separating said monomer-dye compound from said solution comprising said water-soluble reagents.

14. The method of claim 13, wherein said separating step is accomplished by filtering.

15. The method of claim 14, further comprising during said filtering step, rinsing said monomer-dye compound with water.

16. The method of claim 14, further comprising during said filtering step, rinsing said monomer-dye compound with salt and water.

17. The method of claim 13, further comprising prior to said separating step the step of:

adding salt to said aqueous solution.

18. The method of claim 13, wherein said water-soluble hydrophilic monomer is a hydroxy ester of acrylic or methacrylic acid.

19. The method of claim 13, wherein said hydrophilic monomer is 2-hydroxyethyl methacrylate.

20. The method of claim 13, wherein the amount of said hydrophilic monomer in said aqueous solution is about 10–65% by weight of the total weight of said reagents.

21. The method of claim 13, wherein equimolar amounts of said base and said dye are present in said solution during said forming step.

22. The method of claim 14, wherein filtering said dye-monomer compound from said aqueous solution and drying said monomer-dye compound will provide a monomer-dye compound having at least 50% purity as measure by High Pressure Liquid Chromatography.

23. A monomer-dye compound formed by a method comprising the steps of:

forming an aqueous solution comprising water and water-soluble reagents, said reagents comprising water-soluble hydrophilic monomer, water-soluble base, and water-soluble halotriazine dye;

reacting said water-soluble dye with said water-soluble hydrophilic monomer to form a monomer-dye compound, wherein said monomer-dye compound is insoluble in said aqueous solution; and separating said monomer-dye compound from said solution comprising said water-soluble reagents.

24. A monomer-dye compound formed by a method comprising the steps of:

forming an aqueous solution comprising water and water-soluble reagents, said reagents comprising water-soluble base, water-soluble hydrophilic monomer; and water-soluble vinyl-sulfone dye;

reacting said water-soluble dye with said water-soluble hydrophilic monomer to form a monomer-dye compound, wherein said monomer-dye compound is insoluble in said aqueous solution; and separating said monomer-dye compound from said solution comprising said water-soluble reagents.

* * * * *

UNITED STATES PATENT AND TRADEMARK OFFICE

CERTIFICATE OF CORRRECTION

PATENT NO. : 5,944,853
DATED : August 31, 1999
INVENTOR(S) : Frank F. Molock, et al.

It is certified that error appears in the above-identified patent and that said Letters Patent is hereby corrected as shown below: On the title page: Item [56] insert the following:

FOREIGN PATENT OR PUBLISHED FOREIGN PATENT APPLICATION

| | | DOCUMENT NUMBER | | | | | | | PUBLICATION DATE | COUNTRY OR PATENT OFFICE | CLASS | SUBCLASS | TRANSLATION YES | TRANSLATION NO |
|---|---|---|---|---|---|---|---|---|---|---|---|---|---|---|
| | JP | A | 2 | 2 | 8 | 2 | 3 | 8 5 | 11/19/90 | Japan(Abstract only) | | | | |

Signed and Sealed this

Twenty-third Day of May, 2000

*Attest:*

Q. TODD DICKINSON

*Attesting Officer*

*Director of Patents and Trademarks*